US008480222B2

(12) United States Patent
Nishikawa et al.

(10) Patent No.: US 8,480,222 B2
(45) Date of Patent: Jul. 9, 2013

(54) DROPLET EJECTION HEAD, DROPLET EJECTION APPARATUS, AND METHOD OF COLLECTING BUBBLES IN DROPLET EJECTION HEAD

(75) Inventors: Baku Nishikawa, Kanagawa-ken (JP); Shinji Seto, Ebina (JP); Naoki Morita, Ebina (JP)

(73) Assignees: FUJIFILM Corporation, Tokyo (JP); Fuji Xerox Co., Ltd., Tokyo (JP)

( * ) Notice: Subject to any disclaimer, the term of this patent is extended or adjusted under 35 U.S.C. 154(b) by 413 days.

(21) Appl. No.: 12/900,274

(22) Filed: Oct. 7, 2010

(65) Prior Publication Data

US 2011/0085012 A1 Apr. 14, 2011

(30) Foreign Application Priority Data

Oct. 8, 2009 (JP) ..... 2009-234423

(51) Int. Cl.
*B41J 2/18* (2006.01)

(52) U.S. Cl.
USPC ..... 347/94; 347/89; 347/92

(58) Field of Classification Search
USPC ..... 347/94, 92, 89
See application file for complete search history.

(56) References Cited

U.S. PATENT DOCUMENTS

| | | | | |
|---|---|---|---|---|
| 5,777,649 | A * | 7/1998 | Otsuka et al. | 347/94 |
| 6,331,050 | B1 * | 12/2001 | Nakata et al. | 347/89 |
| 7,303,271 | B2 | 12/2007 | Shimizu et al. | |
| 2001/0019348 | A1 * | 9/2001 | Yano et al. | 347/94 |
| 2006/0061634 | A1 * | 3/2006 | Hori | 347/71 |
| 2008/0079759 | A1 * | 4/2008 | Nagashima | 347/10 |
| 2008/0198208 | A1 * | 8/2008 | Kyoso et al. | 347/85 |
| 2010/0091055 | A1 * | 4/2010 | Kawakami et al. | 347/9 |
| 2010/0214359 | A1 * | 8/2010 | Von Essen et al. | 347/42 |

FOREIGN PATENT DOCUMENTS

| | | | |
|---|---|---|---|
| JP | 7-125235 | A | 5/1995 |
| JP | 11-10911 | A | 1/1999 |
| JP | 2000-117998 | A | 4/2000 |
| JP | 2005-145051 | A | 6/2005 |

* cited by examiner

*Primary Examiner* — Shelby Fidler
(74) *Attorney, Agent, or Firm* — Birch, Stewart, Kolasch & Birch, LLP

(57) ABSTRACT

The droplet ejection head includes: a plurality of droplet ejection units which include ejection ports through which droplets of liquid are ejected, pressure chambers which are connected to the ejection ports through connection channels, drive elements which apply pressure to the liquid in the pressure chambers, supply channels through which the liquid is supplied to the pressure chambers, and return channels through which the liquid is returned from the connection channels; a common supply channel through which the liquid is supplied to the supply channels; and a common return channel through which the liquid is returned from the return channels, the common return channel including a stagnant flow region having a bubble collection section where bubbles are collected, wherein pressure variation occurring in each pressure chamber when ejecting a droplet of the liquid propagates more readily in the common return channel than in the common supply channel.

24 Claims, 16 Drawing Sheets

DROPLET EJECTION HEAD, DROPLET EJECTION APPARATUS, AND METHOD OF COLLECTING BUBBLES IN DROPLET EJECTION HEAD

BACKGROUND OF THE INVENTION

1. Field of the Invention

The present invention relates to a droplet ejection head having a circulation flow channel, a droplet ejection apparatus including the droplet ejection head, and a method of collecting bubbles in the droplet ejection head.

2. Description of the Related Art

There are known inkjet type print heads (inkjet heads) in which ink is supplied to a plurality of pressure chambers from a common flow channel storing the ink, each pressure generating element is actuated to apply pressure to the ink inside a corresponding one of the pressure chambers, and the ink is ejected from a nozzle connected to the pressure chamber. In these print heads, a phenomenon known as fluid cross-talk is liable to occur whereby the pressure change affects the adjacent nozzles (and in particular, the meniscus therein) through the flow channels, and hence a structure which impedes the transmission of pressure to adjacent nozzles by arranging dampers inside the flow channels is used widely as a countermeasure to the cross-talk. However, in recent years, it has become difficult to introduce dampers due to the high density of the head.

In view of the aforementioned problems, Japanese Patent Application Publication No. 11-010911, for instance, discloses an inkjet recording apparatus in which air chambers are arranged in an ink circulation channel and a return channel, in order to alleviate pressure variation caused by a pump. However, such air damping devices generally need to ensure a prescribed height in order to make air enter into recording heads, and hence there has been a problem in that the ink volume becomes large. Moreover, since the air damping devices are disposed at locations distant from the nozzles, then although an effect in preventing pressure variation caused by the pump can be expected, the ability to damp the pressure variation produced by the ejection from the nozzles has been little.

Japanese Patent Application Publication No. 2005-145051 discloses an inkjet printer which suppresses pressure variation in the nozzles of a recording head by arranging compact damper devices. By arranging the damper devices, a large beneficial effect in suppressing fluid cross-talk can be expected; however, there is a problem in that the structure becomes complex and the manufacturing process is laborious.

Japanese Patent Application Publication No. 2000-117998 discloses an inkjet recording apparatus including an air damping device having an air storage unit in the vicinity of a recording head. The horizontal cross-sectional area of an ink storage unit is made smaller compared to the air storage unit so that increase in the ink capacity is prevented; however, since there is a large air storage unit, then it is difficult to align heads or compactify heads. Moreover, similarly to Japanese Patent Application Publication No. 11-010911, since there are no dampers in the vicinity of the nozzles, then it is thought that there is little beneficial effect in suppressing fluid cross-talk.

Japanese Patent Application Publication No. 07-125235 discloses an inkjet head in which a damper chamber is arranged in a portion of the common liquid chamber of an inkjet head, and pressure variation produced in the common liquid chamber is absorbed by this damper chamber. Moreover, a method of producing bubbles is also disclosed in which bubbles are generated by producing film boiling in the ink by means of a heater. However, there is no investigation into an inkjet head having a circulation flow channel.

SUMMARY OF THE INVENTION

The present invention has been contrived in view of these circumstances, an object thereof being to provide a droplet ejection head having a circulation flow channel wherein fluid cross-talk can be reduced, and compactification of the head can also be achieved, and to provide a droplet ejection apparatus having the droplet ejection head, and a method of collecting bubbles in the droplet ejection head.

In order to attain the aforementioned object, the present invention is directed to a droplet ejection head, comprising: a plurality of droplet ejection units which include ejection ports through which droplets of liquid are ejected, pressure chambers which are connected to the ejection ports through connection channels, drive elements which apply pressure to the liquid in the pressure chambers, supply channels through which the liquid is supplied to the pressure chambers, and return channels through which the liquid is returned from the connection channels; a common supply channel through which the liquid is supplied to the supply channels; and a common return channel through which the liquid is returned from the return channels, the common return channel including a stagnant flow region having a bubble collection section where bubbles are collected, wherein pressure variation occurring in each pressure chamber when ejecting a droplet of the liquid propagates more readily in the common return channel than in the common supply channel.

According to this aspect of the present invention, in the droplet ejection head comprising the plurality of droplet ejection units, the common supply channel and the common return channel, since the common return channel includes the stagnant flow region having the bubble collection section for collecting bubbles, then it is possible to use the bubble collection section as a damper. By making it possible for the pressure change occurring in the pressure chambers to be propagated readily in the common return channel, since the bubble collection section for collecting the bubbles is arranged in the common return channel, then it is possible to suppress pressure change. Consequently, it is possible to perform ejection without the pressure from one droplet ejection unit affecting the other droplet ejection units.

Furthermore, by preparing the bubble collection section which collects the bubbles, it is possible to suppress the outflow of bubbles as a result of circulation.

Preferably, a flow channel resistance of the return channels is smaller than a flow channel resistance of the supply channels.

According to this aspect of the present invention, a concrete composition is specified for making the pressure change propagate readily in the common return channel, and the pressure change can be made to propagate readily in the common return channel by making the flow channel resistance of the return channel smaller than the flow channel resistance of the supply channel. Moreover, since the bubbles can be made to travel more readily to the common return channel than the common supply channel, it is possible to collect the bubbles in the common return channel.

Preferably, the droplet ejection head further comprises: a dummy pressure chamber which does not contribute to ejection of the liquid and to which the liquid is supplied from the common supply channel; and a second drive element which applies pressure to the liquid in the dummy pressure chamber to generate the bubbles.

According to this aspect of the present invention, by driving the second drive element which applies pressure to the liquid in the dummy pressure chamber, it is possible to generate bubbles in the liquid or to introduce bubbles into the liquid, and therefore, it is possible to suppress fluid cross-talk by introducing these bubbles inside the common return channel.

Preferably, a flow channel from the common supply channel through the dummy pressure chamber to the common return channel is in a closed state.

According to this aspect of the present invention, by setting the flow channel from the common supply channel through the dummy pressure chamber to the common return channel, to the closed state, and by driving the second drive element, the circulation pressure inside the dummy pressure chamber is raised and the amount of dissolved air (i.e., nitrogen and oxygen) in the liquid is adjusted, thereby making it possible to generate bubbles readily. Furthermore, since the flow channel is in the closed state, it is possible to suppress blocking of the flow channels and nozzles due to intermixing of impurities. By introducing these bubbles inside the common return channel, it is possible to suppress fluid cross-talk.

Preferably, the droplet ejection head further comprises: a dummy ejection port which is connected to the dummy pressure chamber and does not contribute to ejection of the liquid.

According to this aspect of the present invention, by arranging the dummy ejection port which is connected to the dummy pressure chamber and by driving the second drive element, it is possible to introduce bubbles from the dummy ejection port. Therefore, it is possible to suppress fluid cross-talk.

Preferably, the droplet ejection head further comprises: a bypass flow channel which connects the common supply channel with the common return channel.

According to this aspect of the present invention, it is possible to generate bubbles in the liquid readily by arranging the bypass flow channel which connects the common supply channel with the common return channel. Furthermore, since the bubbles are conveyed from the common supply channel to the common return channel without passing through the pressure chambers, then it is possible to suppress ejection defects caused by bubbles entering into the pressure chambers.

Preferably, the bypass flow channel includes an air flow channel which connects to atmosphere.

According to this aspect of the present invention, since the bypass flow channel is provided with the air flow channel connected to the atmosphere, it is possible to introduce air readily.

Preferably, the droplet ejection head further comprises: a bubble detection device which detects the bubbles in the common return channel.

According to this aspect of the present invention, since the bubble detection device which detects the bubbles is arranged, then it is possible to detect the presence or absence of bubbles. Furthermore, since the volume of bubbles is determined during image formation, then even in cases where the bubbles have been circulated together with the liquid due to the circulation of the liquid, it is still possible to form an image while performing confirmation and introduction of bubbles.

In order to attain the aforementioned object, the present invention is also directed to a droplet ejection apparatus, comprising: the above-described droplet ejection head; a circulation device which is connected to the common supply channel and the common return channel and circulates the liquid; and a drive device which drives the drive elements and serves as a bubble introduction device which introduces the bubbles into the liquid.

According to this aspect of the present invention, since the bubble introduction device is the drive device which drives the drive elements, then it is possible to introduce bubbles into the liquid without involving major design changes. Furthermore, since the bubbles can be introduced through the ejection port, then it is possible to introduce bubbles readily into the bubble collection section of the common return channel.

In order to attain the aforementioned object, the present invention is also directed to a droplet ejection apparatus, comprising: the above-described droplet ejection head; a circulation device which is connected to the common supply channel and the common return channel and circulates the liquid; and a drive device which drives the second drive element and serves as a bubble generation device which generates the bubbles in the dummy pressure chamber.

According to this aspect of the present invention, since bubbles can be generated by driving the second drive element which is arranged at the dummy pressure chamber that does not contribute to droplet ejection, it is possible to suppress the occurrence of ejection defects due to the effects of the bubbles in the pressure chambers which are used for actual image formation. Furthermore, since the dummy pressure chamber which does not contribute to droplet ejection produces a pressure variation, then it is possible to create a pressure variation under conditions which are suited to the generation of bubbles.

In order to attain the aforementioned object, the present invention is also directed to a droplet ejection apparatus, comprising: the above-described droplet ejection head; a circulation device which is connected to the common supply channel and the common return channel and circulates the liquid; and a drive device which drives the second drive element and serves as a bubble introduction device which introduces the bubbles from the dummy ejection port.

According to this aspect of the present invention, since bubbles can be introducing from the dummy ejection port by driving the second drive element which is arranged at the dummy pressure chamber that does not contribute to droplet ejection, it is possible to suppress the occurrence of ejection defects due to the effects of the bubbles in the pressure chambers which are used for actual image formation. Moreover, by introducing bubbles from the dummy ejection port, it is possible to introduce bubbles from a position close to the common return channel, and therefore it is possible to introduce bubbles readily into the common return channel. Furthermore, since the dummy pressure chamber produces a pressure variation, then it is possible to create a pressure variation under conditions which are suited to the introduction of bubbles.

In order to attain the aforementioned object, the present invention is also directed to a droplet ejection apparatus, comprising: the above-described droplet ejection head; a supply tube through which the liquid is supplied to the common supply channel, the supply tube including an air flow tube which connects to atmosphere and has a valve; a return tube through which the liquid is returned from the common return channel; and a circulation device which is connected to the supply tube and the return tube and circulates the liquid, wherein the air flow tube and the circulation device serve as a bubble introduction device which introduces the bubbles into the liquid.

According to this aspect of the present invention, by arranging the supply tube which connects to the circulation flow channel and by introducing bubbles from the air flow tube arranged on the supply tube, it is possible to introduce bubbles readily inside the common return channel.

Preferably, the droplet ejection apparatus further comprises a bubble detection device which detects the bubbles in the common return channel; and a control device which controls the bubble introduction device or the bubble generation device in accordance with a result obtained by the bubble detection device.

According to this aspect of the present invention, since the bubble detection device which detects the bubbles in the common return channel is arranged and the control device controls the volume of bubble in accordance with the result obtained by the bubble detection device, then it is possible to carry out image formation in a state where a sufficient volume of bubbles is contained in the common return channel.

In order to attain the aforementioned object, the present invention is also directed to a method of collecting bubbles in a droplet ejection head in a droplet ejection apparatus which comprises: the droplet ejection head, including: a plurality of droplet ejection units which include ejection ports through which droplets of liquid are ejected, pressure chambers which are connected to the ejection ports through connection channels, drive elements which apply pressure to the liquid in the pressure chambers, supply channels through which the liquid is supplied to the pressure chambers, and return channels through which the liquid is returned from the connection channels; a common supply channel through which the liquid is supplied to the supply channels; and a common return channel through which the liquid is returned from the return channels, the common return channel including a stagnant flow region having a bubble collection section where bubbles are collected, wherein pressure variation occurring in each pressure chamber when ejecting a droplet of the liquid propagates more readily in the common return channel than in the common supply channel; a circulation device which is connected to the common supply channel and the common return channel and circulates the liquid; and a drive device which drives the drive elements and serves as a bubble introduction device which introduces the bubbles into the liquid, the method comprising the step of introducing the bubbles from one of the ejection ports by driving a corresponding one of the drive elements.

In order to attain the aforementioned object, the present invention is also directed to a method of collecting bubbles in a droplet ejection head in a droplet ejection apparatus which comprises: the droplet ejection head, including: a plurality of droplet ejection units which include ejection ports through which droplets of liquid are ejected, pressure chambers which are connected to the ejection ports through connection channels, drive elements which apply pressure to the liquid in the pressure chambers, supply channels through which the liquid is supplied to the pressure chambers, and return channels through which the liquid is returned from the connection channels; a common supply channel through which the liquid is supplied to the supply channels; a common return channel through which the liquid is returned from the return channels, the common return channel including a stagnant flow region having a bubble collection section where bubbles are collected; a dummy pressure chamber which does not contribute to ejection of the liquid and to which the liquid is supplied from the common supply channel; and a second drive element which applies pressure to the liquid in the dummy pressure chamber to generate the bubbles, wherein: pressure variation occurring in each pressure chamber when ejecting a droplet of the liquid propagates more readily in the common return channel than in the common supply channel; and a flow channel from the common supply channel through the dummy pressure chamber to the common return channel is in a closed state; a circulation device which is connected to the common supply channel and the common return channel and circulates the liquid; and a drive device which drives the second drive element and serves as a bubble generation device which generates the bubbles in the dummy pressure chamber, the method comprising the step of generating the bubbles in the dummy pressure chamber by driving the second drive element.

In order to attain the aforementioned object, the present invention is also directed to a method of collecting bubbles in a droplet ejection head in a droplet ejection apparatus which comprises: the droplet ejection head, including: a plurality of droplet ejection units which include ejection ports through which droplets of liquid are ejected, pressure chambers which are connected to the ejection ports through connection channels, drive elements which apply pressure to the liquid in the pressure chambers, supply channels through which the liquid is supplied to the pressure chambers, and return channels through which the liquid is returned from the connection channels; a common supply channel through which the liquid is supplied to the supply channels; a common return channel through which the liquid is returned from the return channels, the common return channel including a stagnant flow region having a bubble collection section where bubbles are collected; a dummy pressure chamber which does not contribute to ejection of the liquid and to which the liquid is supplied from the common supply channel; a second drive element which applies pressure to the liquid in the dummy pressure chamber to generate the bubbles; and a dummy ejection port which is connected to the dummy pressure chamber and does not contribute to ejection of the liquid, wherein pressure variation occurring in each pressure chamber when ejecting a droplet of the liquid propagates more readily in the common return channel than in the common supply channel; a circulation device which is connected to the common supply channel and the common return channel and circulates the liquid; and a drive device which drives the second drive element and serves as a bubble introduction device which introduces the bubbles from the dummy ejection port, the method comprising the step of introducing the bubbles from the dummy ejection port by driving the second drive element.

In order to attain the aforementioned object, the present invention is also directed to a method of collecting bubbles in a droplet ejection head in a droplet ejection apparatus which comprises: the droplet ejection head, including: a plurality of droplet ejection units which include ejection ports through which droplets of liquid are ejected, pressure chambers which are connected to the ejection ports through connection channels, drive elements which apply pressure to the liquid in the pressure chambers, supply channels through which the liquid is supplied to the pressure chambers, and return channels through which the liquid is returned from the connection channels; a common supply channel through which the liquid is supplied to the supply channels; and a common return channel through which the liquid is returned from the return channels, the common return channel including a stagnant flow region having a bubble collection section where bubbles are collected, wherein pressure variation occurring in each pressure chamber when ejecting a droplet of the liquid propagates more readily in the common return channel than in the common supply channel; a supply tube through which the liquid is supplied to the common supply channel, the supply tube including an air flow tube which connects to atmosphere and has a valve; a return tube through which the liquid is returned from the common return channel; and a circulation device which is connected to the supply tube and the return tube and circulates the liquid, wherein the air flow tube and the circulation device serve as a bubble introduction device which introduces the bubbles into the liquid, the method comprising the step of introducing the bubbles from the air flow tube by driving the circulation device.

Preferably, the droplet ejection apparatus further comprises a bubble detection device which detects the bubbles in the common return channel, and a control device which controls the bubble introduction device or the bubble generation device in accordance with a result obtained by the bubble detection device; and the method further comprises the step of controlling a volume of the bubbles in the common flow channel in accordance with the result obtained by the bubble detection device.

According to these aspects of the present invention, the methods for collecting bubbles in the droplet ejection heads of the above-described droplet ejection apparatuses are prepared, and it is possible to introduce bubbles into the bubble collection section in the common return channel, in accordance with respective droplet ejection apparatuses.

According to the present invention, in a droplet ejection head having a circulation flow channel, it is possible to make the droplet ejection head compact while suppressing fluid cross-talk, in comparison with a case where a bubble collection section for collecting bubbles is not arranged in the common return channel.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

First Embodiment

Figure 1:
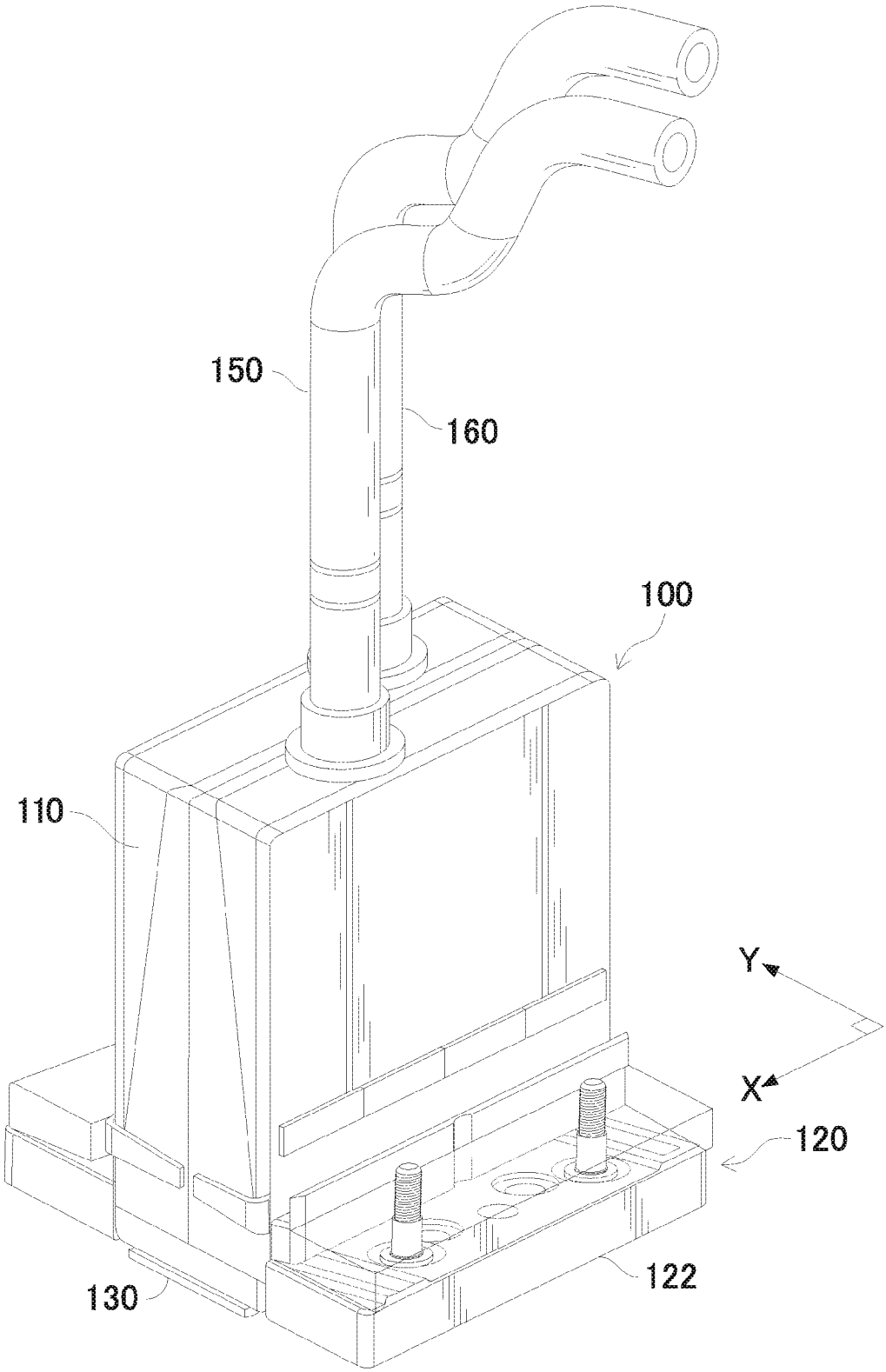
FIG. 1 is a perspective diagram of a droplet ejection head according to an embodiment of the present invention.

FIG. 1 is a perspective diagram of a droplet ejection head 100. The droplet ejection head 100 includes: a casing 110; a mounting assembly 120, which has a mounting component 122; and a substrate 130, which is attached to the bottom of the casing 110. The substrate 130 is made of silicon, such as single crystal silicon. Microfabricated fluid flow channels (see FIGS. 2 and 3) are formed in the substrate 130. A supply tube 150 and a return tube 160 are connected to a liquid tank 191 (not shown in FIG. 1, and shown in FIG. 8), and are connected to the droplet ejection head 100.

Figure 2:
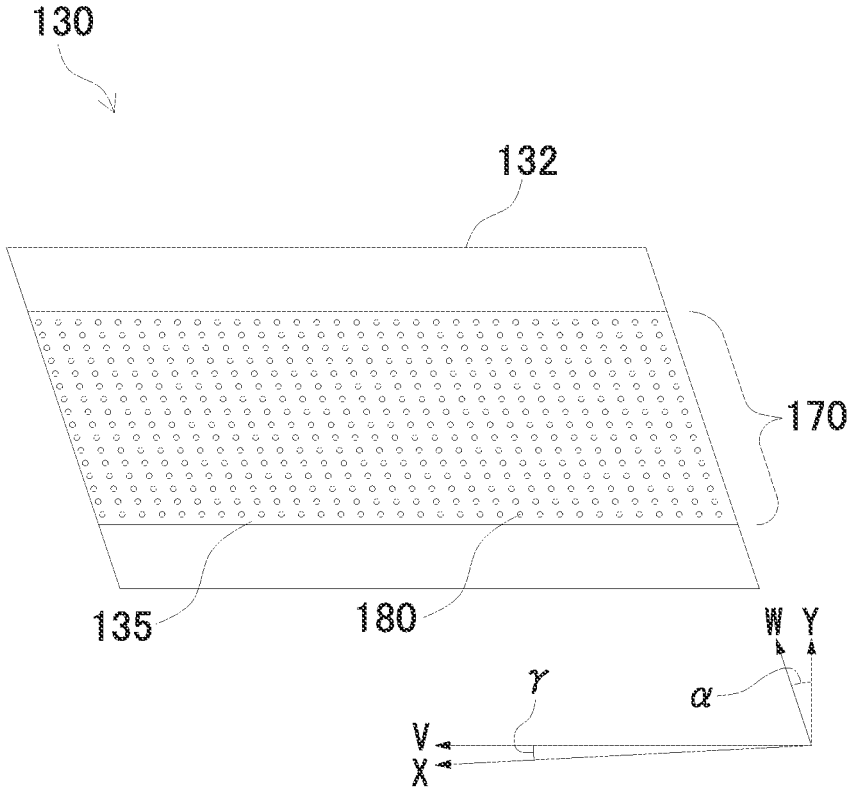
FIG. 2 is a diagram showing the bottom surface (nozzle arrangement) of a substrate.

FIG. 2 shows the bottom surface of the substrate 130. The substrate 130 includes a nozzle layer 132, and the nozzle layer 132 has a nozzle face 135. The nozzle face 135 includes a plurality of columns 170 of nozzles 180. The nozzle face 135 has a quadrilateral shape, and has long edges in a V direction that is at an angle of $\gamma$ relative to the X direction. The nozzle face 135 has short edges in a W direction that is at an angle of $\alpha$ relative to the Y direction. The W direction can be at another oblique angle relative to the width of the substrate 130. The nozzle face 135 can be formed as a surface of a separate nozzle layer 132. Alternatively, it is also possible that the nozzle face 135 and the nozzle layer 132 are formed as a unitary part of the substrate 130.

Figure 3A:
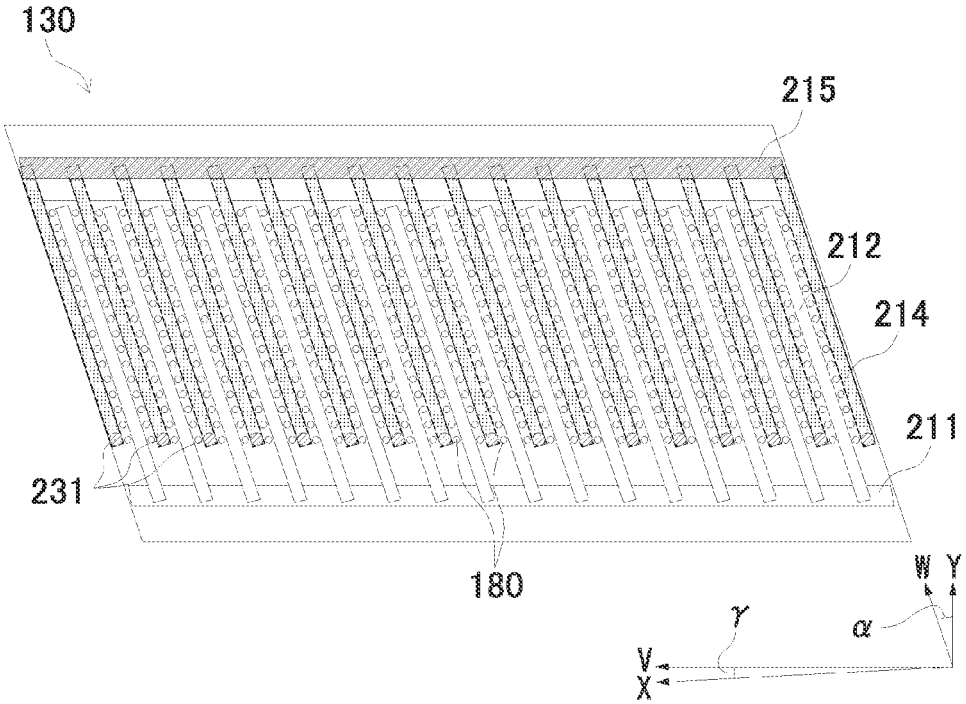
FIG. 3A is a plan view perspective diagram showing a flow of liquid inside a substrate.
Figure 3B:
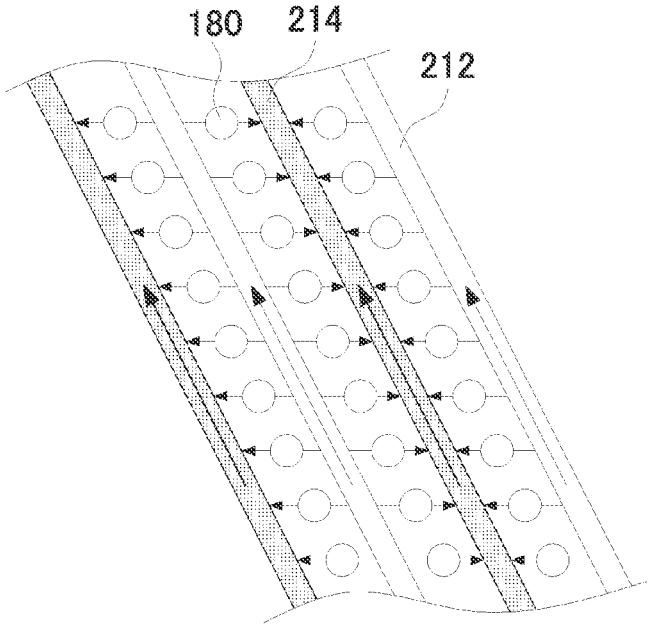
FIG. 3B is a partial enlarged view of same.

FIG. 3A is a plan view perspective diagram showing the flow of liquid in the substrate 130, and FIG. 3B is a partial enlarged view of same. As shown in FIGS. 3A and 3B, the substrate 130 includes a first main flow channel 211, which is connected to the supply tube 150, and a plurality of common supply channels 212, which extend in a direction intersecting with the first main flow channel 211. The substrate 130 further includes a plurality of droplet ejection units, which have nozzles 180 to eject liquid droplets and are arranged in a direction intersecting with the common supply channels 212, and common return channels 214, which oppose the nozzles 180 and return the liquid. The substrate 130 also includes a second main flow channel 215, which extends in a direction intersecting with the lengthwise direction of the common return channels 214. The second main flow channel 215 is connected to the return tube 160, and circulates the liquid.

As shown in FIG. 3B, the droplet ejection units are arranged with flow channels formed on either side of the common supply channels 212 in a direction intersecting with the common supply channels 212, in such a manner that the liquid flows from two droplet ejection units to the common return channel 214.

Figure 4:
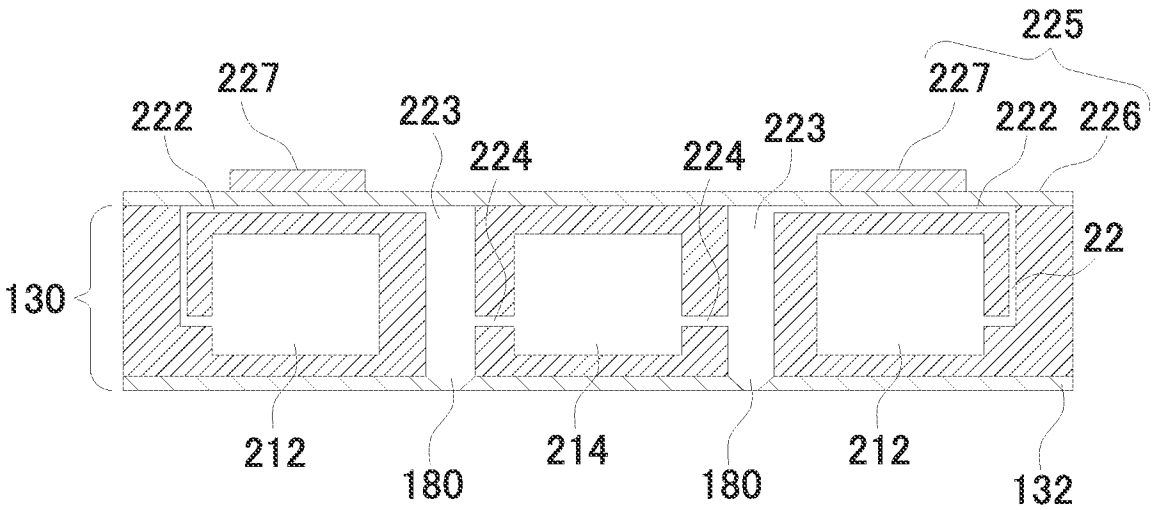
FIG. 4 is a principal cross-sectional diagram of the substrate.

FIG. 4 is a principal cross-sectional diagram of the substrate 130 shown in FIGS. 3A and 3B. Although not shown in FIG. 4, the substrate 130 is also provided with the nozzles and the flow channels arranged extending from the common supply channels 212 to the opposite side to the nozzles 180 as shown in FIGS. 3A and 3B.

As shown in FIGS. 3A to 4, the substrate 130 is provided internally with the common supply channels 212, which are connected to the first main flow channel 211, and the common return channels 214, which are connected to the second main flow channel 215. The substrate 130 is also provided internally with supply channels 221, pressure chambers 222, connection channels 223 and return channels 224. Each supply channel 221 connects the common supply channel 212 to the pressure chamber 222, and each pressure chamber 222 is connected to the connection channel 223. Each connection channel 223 is connected to the nozzle 180, and droplets of the liquid are ejected from the nozzle 180 through the connection channel 223 due to pressure change in the pressure chamber 222. The connection channels 223 are connected to the common return channels 214 through the return channels 224, and surplus liquid is circulated through the common return channels 214. Furthermore, actuators 225 applying pressure to the liquid inside the pressure chambers 222 are arranged on the substrate 130 at positions adjacent to the pressure chambers 222. Each actuator 225 has a plate-shaped diaphragm 226 and a drive element 227.

Thus, the droplet ejection units, each of which includes the supply channel 221, the pressure chamber 222, the connection channel 223, the nozzle 180 and the return channel 224, are connected to each other through the common supply channel 212 and the common return channel 214. Consequently, the pressure applied to the pressure chamber in one of the droplet ejection units affects other droplet ejection units, and hence fluid cross-talk has occurred whereby it is not possible to perform suitable ejection in the affected droplet ejection units.

In the first embodiment of the present invention, it is possible to collect bubbles inside the common return channels 214, which are able to act as dampers, and thus fluid cross-talk can be suppressed. Moreover, by collecting bubbles inside the common return channels 214 and using same as dampers, there is no need to prepare separate damper chambers, or the like, and hence the size of the head can be reduced. If bubbles are collected in the common supply chambers 212, there are cases where the collected bubbles flow into the pressure chambers 222 due to the flow of the liquid. If bubbles enter into the pressure chambers 222, then it becomes difficult to apply pressure directly to the liquid, and it becomes difficult to control the ejection volume of the droplets. Therefore, the bubbles are introduced into and held in the common return channels 214.

A bubble collection section 231 for collecting bubbles is arranged in a stagnant flow region of each common return channel 214. The bubble collection section 231 can also be arranged inside the common return channel 214 so as to facilitate the collection of bubbles therein. A portion where bubbles are accumulated in the common return channel 214 can be used as the bubble collection section. As shown in FIG. 3A, the bubble collection section 231 is desirably arranged at an extremity of the common return channel 214 on the side opposite to the second main flow channel 215. The extremity of the common return channel 214 is at a bottom of the return channels 224 in terms of the liquid flow, and then forms a stagnant flow region, where bubbles can collect. It is also possible to arrange a stagnant flow region through which no liquid travels during the circulation, at an intermediate point of each common return channel 214, and to use this stagnant flow region as the bubble collection section.

Figure 5A:
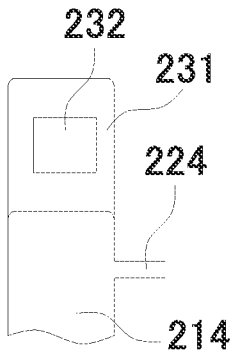
FIGS. 5A to 5C are diagrams for describing shapes of bubble collection sections.
Figure 5B:
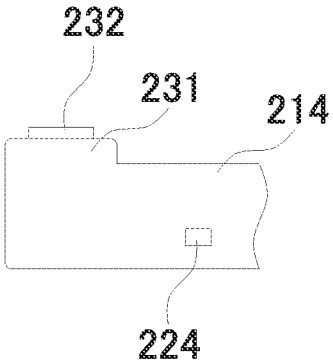
Figure 5C:
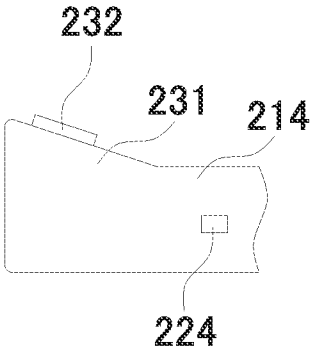

FIGS. 5A to 5C show shapes of the bubble collection sections 231. FIG. 5A is a plan diagram of the common return channel 214, having a structure in which the extremity of the common return channel 214 is lengthened so as to make the stagnant flow region long. A dashed line in FIG. 5A represents a position where a wall of a common return channel in the related art is situated. By making the extremity of the common return channel 214 longer than the related art, it is possible to form the stagnant flow region in the lengthened portion. Thus, it is possible to prevent the collected bubbles from traveling together with the liquid, and hence the bubbles can be kept inside the channel for a long period of time. FIGS. 5B and 5C are side view diagrams of the common return channels 214. FIG. 5B shows a composition where a recess is arranged in the extremity of the common return channel 214, and FIG. 5C shows a composition where a slant is arranged in the extremity of the common return channel 214. Both of the structures shown in FIGS. 5B and 5C are also able to prevent the collected bubbles from traveling together with the liquid, and hence it is possible to hold the bubbles in the channel for a long period of time.

<Method of Introducing Bubbles>

Figure 6A:
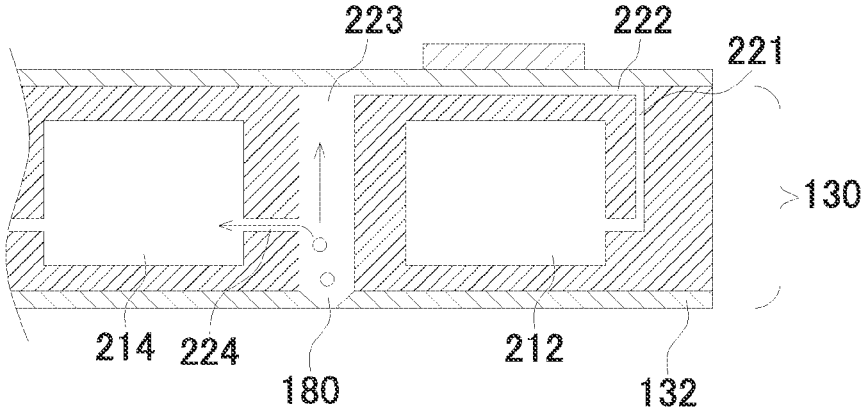
FIGS. 6A to 6D are diagrams for describing a method of introducing bubbles into a common return channel.
Figure 6B:
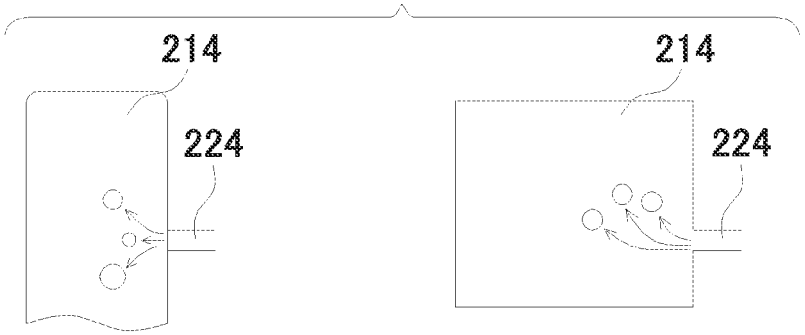
Figure 6C:
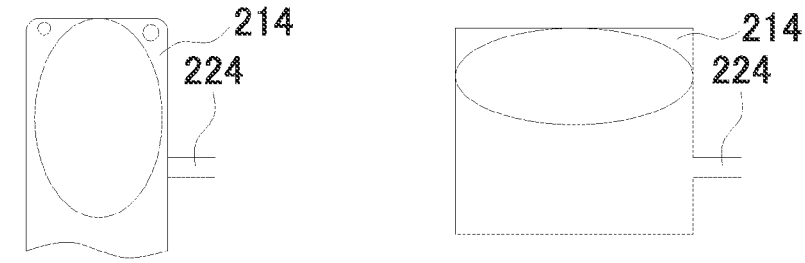
Figure 6D:
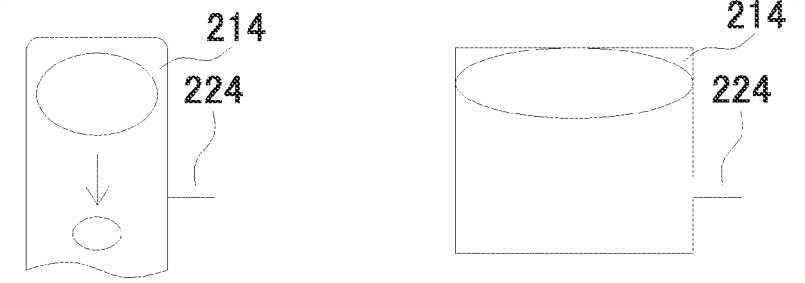

There follows a description of a method of introducing bubbles into the common return channels 214 in the droplet ejection head having the substrate 130 shown in FIGS. 3A to 4. FIGS. 6A to 6D are diagrams for describing the method of introducing bubbles into the common return channel 214, in which FIG. 6A is a front side cross-sectional diagram of the substrate 130, FIG. 6B is a plan diagram and a front side cross-sectional diagram of the common return channel 214, FIG. 6C is a plan diagram and a front side cross-sectional diagram of the common return channel 214 showing a state after the state shown in FIG. 6B, and FIG. 6D is a plan diagram and a front side cross-sectional diagram of the common return channel 214 showing a state after the state shown in FIG. 6C.

Figure 7A:
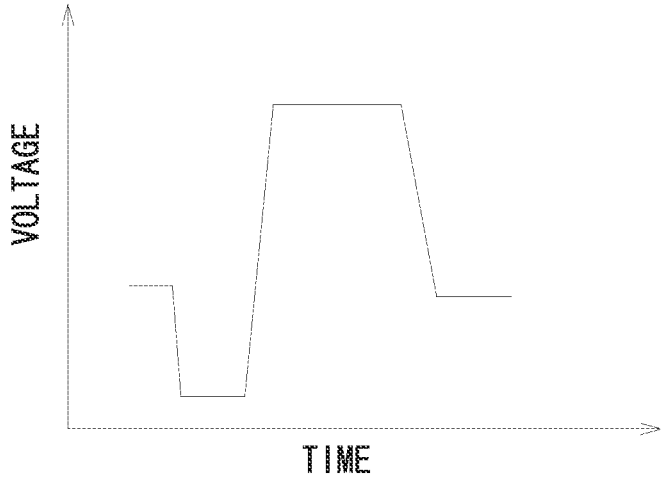
FIGS. 7A and 7B are waveform diagrams for describing signals used when introducing bubbles from a nozzle.
Figure 7B:
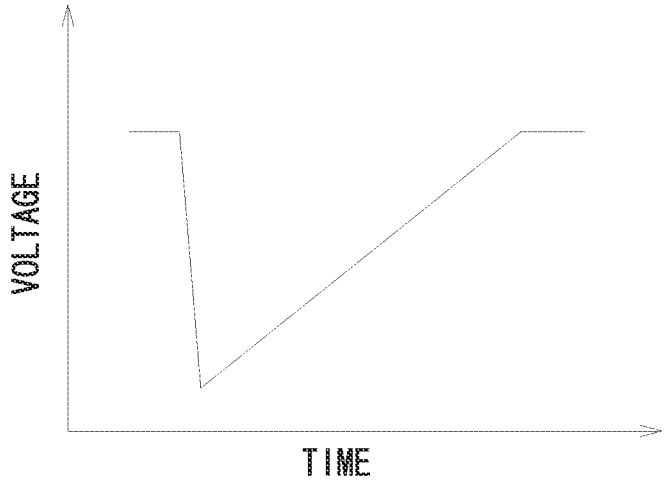

In the droplet ejection head 100, as shown in FIG. 6A, bubbles can be introduced through the nozzles 180, which are used to form an image, and these bubbles can be moved to the common return channel 214 by circulation. Possible examples of the method of introducing bubbles through the nozzles 180 include a method which applies a pressure change to the meniscus, and a method which introduces fine bubbles by disturbing the meniscus by means of a waveform. A method of inducing pressure change to be applied to the meniscus can be implemented by squeezing and releasing a tube, for example. Examples of the waveform for disturbing the meniscus include those shown in FIGS. 7A and 7B, in which the vertical axis represents a voltage applied to the actuator 225 (see FIG. 4). In FIG. 7A, it is possible to disturb the meniscus and introduce bubbles by firstly pulling the meniscus slightly, and then pushing and pulling the meniscus again strongly. In FIG. 7B, it is possible to disturb the meniscus and introduce bubbles by pulling the meniscus strongly from the start.

As shown in FIG. 6B, the bubbles introduced in this way pass through the return channel 224 and move to the common return channel 214 by means of circulation. In the first embodiment, the flow channel resistance of the return channel 224 is set to be lower then the flow channel resistance of the supply channel 221, and it is thereby possible to prevent the introduced bubbles from entering into the common supply channel 212. As a method of making the resistance of the return channel 224 lower than the resistance of the supply channel 221, it is possible to lower the resistance by making the cross-sectional area of the return channel 224 greater than the cross-sectional area of the supply channel 221.

By repeating the operation of introducing bubbles a plurality of times, it is possible to collect the bubbles in the upper part of the common return channel 214 as shown in FIG. 6C. A composition is desirably adopted whereby the bubbles are collected in the stagnant flow region of the common return channel 214, and possible examples of the composition include the compositions shown in FIGS. 5B and 5C. Moreover, by inclining the common return channel 214 so as to become lower toward the second main flow channel 215, it is possible to collect the bubbles at the extremity of the common return channel 214 on the side of the first main flow channel 211.

When the bubbles have been collected, the circulation is carried out forcibly, so that any bubbles in regions which are not a stagnant flow region are moved due to the circulating action. Thus, the bubbles can be collected inside the stagnant flow region only, as shown in FIG. 6D.

<Method of Detecting Bubbles>

In the first embodiment, it is desirable to arrange a bubble detection device which detects bubbles collected inside the common return channel 214 as described above. By using the bubble detection device, it is possible to introduce bubbles inside the common return channel 214 while adjusting the volume of bubbles inside the common return channel 214. Moreover, it is desirable that the volume of bubbles inside the common return channel 214 can be determined after image formation, since the bubbles can flow together with the liquid when circulating the liquid.

It is possible to detect the bubbles by using an impedance analyzer 190 (see FIG. 8) as the bubble detection device. More specifically, an actuator that does not contribute to image formation is arranged, a pressure rebound created when this actuator is driven is determined by means of the impedance analyzer, and it is thereby possible to determine the volume of bubbles inside the common return channel. A known method can be employed to determine the pressure rebound.

The actuator for the detection of the bubbles is desirably disposed at a position adjacent to the bubble collection section 231 of the common return channel 214. By disposing the actuator in this position, since the actuator can be face the bubble collection section 231 across the wall of the common return channel 214, it is possible to readily determine the pressure rebound when the actuator is driven. More specifically, the positions of the actuator 232 for the detection of bubbles shown in FIGS. 5A to 5C can be adopted, for example.

By introducing bubbles inside the common return channel 214 in this way, it is possible to suppress fluid cross-talk in which the pressure variation caused by the ejection from one ejection port affects ejection from other ejection ports.

<Droplet Ejection Apparatus>

Figure 8:
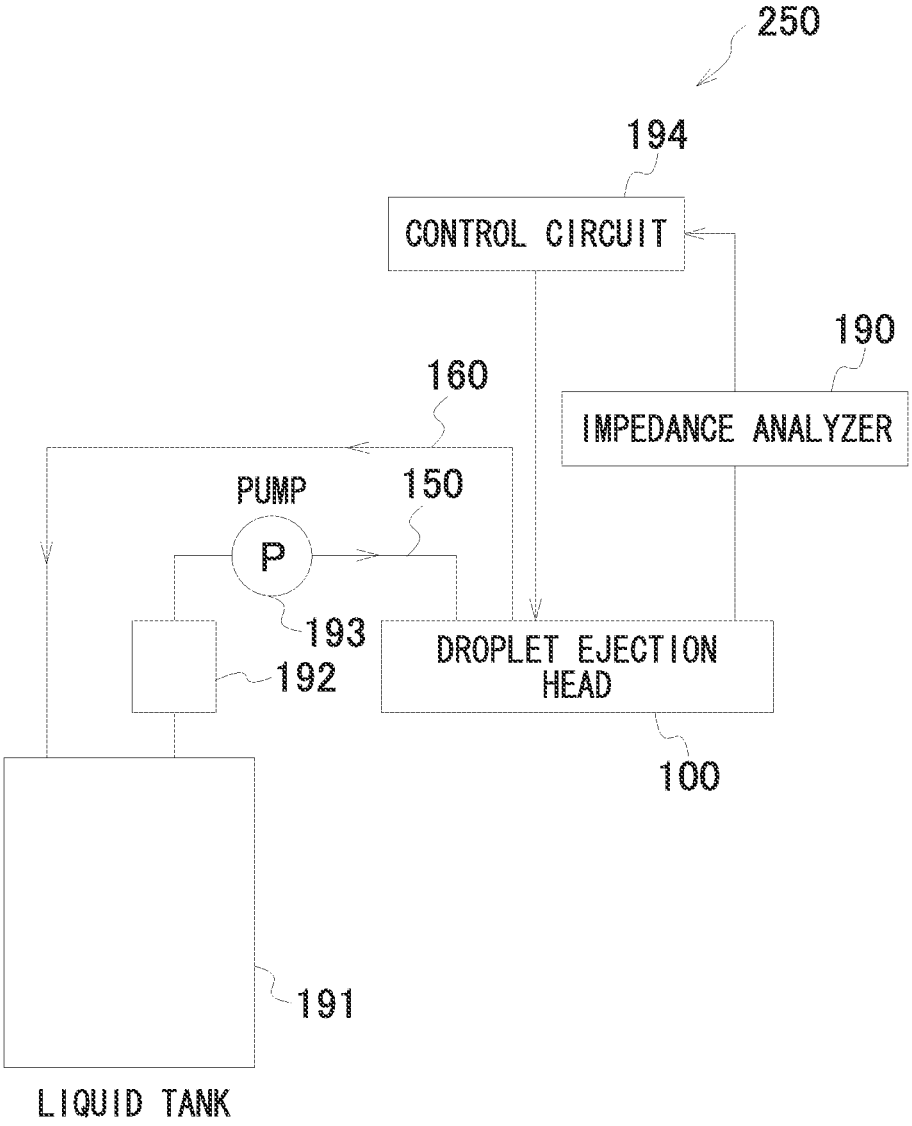
FIG. 8 is a schematic drawing of a droplet ejection apparatus according to an embodiment of the present invention.

FIG. 8 shows a schematic drawing of a droplet ejection apparatus 250 having the droplet ejection head 100. As shown in FIG. 8, the droplet ejection apparatus 250 includes: the supply tube 150, through which the liquid is supplied to the first main flow channel; the return tube 160, through which the liquid is returned from the second main flow channel; and the liquid tank 191, from which the ink is supplied through the supply tube 150 and to which the ink is returned through the return tube 160. The supply tube 150 is provided with a circulation pump 193, which serves as a circulation device, and a deaeration device 192, which deaerates the liquid. By driving the circulation pump 193, the liquid stored in the liquid tank 191 is caused to flow from the liquid tank 191 through the supply tube 150, the droplet ejection head 100 and the return tube 160, and then be returned to the liquid tank 191. Thus, the ink is circulated between the droplet ejection unit and the liquid tank.

In the droplet ejection apparatus 250, a control circuit 194 obtains signals from the impedance analyzer 190, which serves as the bubble detection device, and adjusts the volume of bubbles inside the common return channel 214 by controlling the actuator 225 of the droplet ejection head 100.

Second Embodiment

Figure 9A:
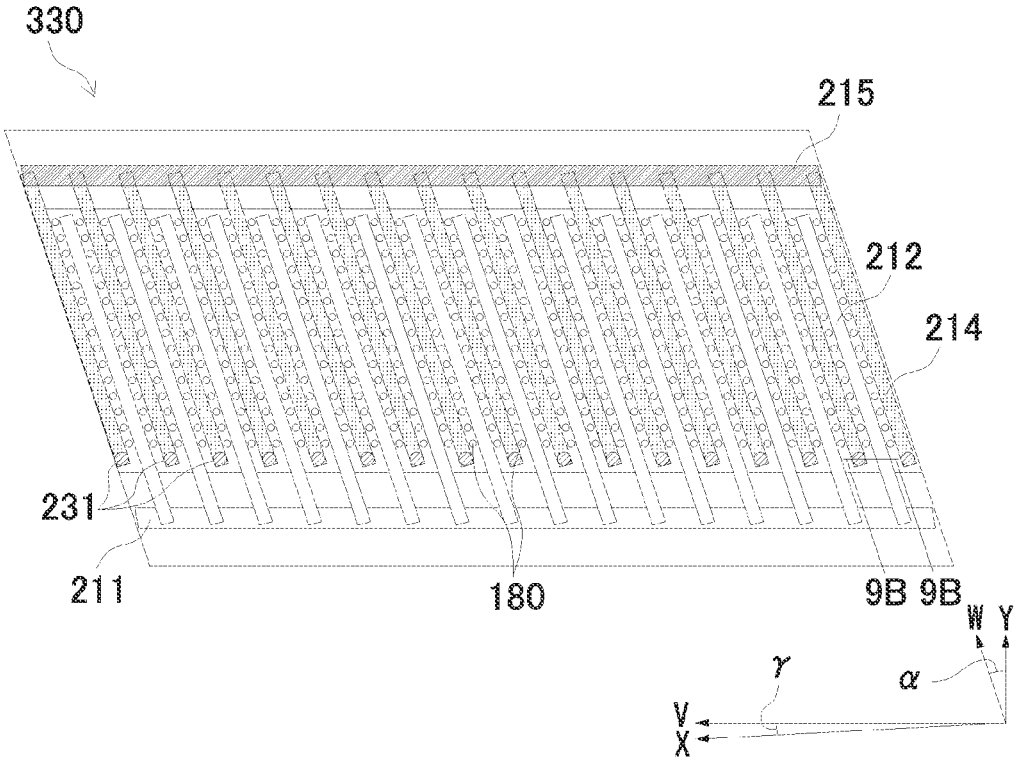
FIG. 9A is a plan view perspective diagram showing the flow of liquid inside a droplet ejection head according to a second embodiment of the present invention.
Figure 9B:
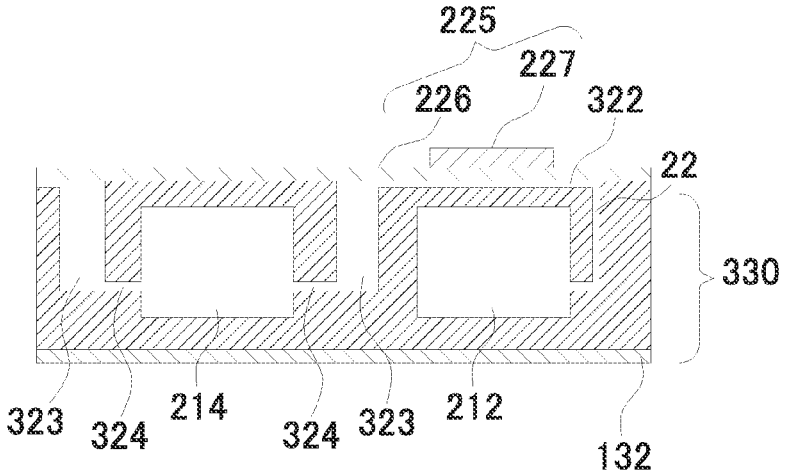
FIG. 9B is a cross-sectional diagram along line 9B-9B in FIG. 9A.

FIG. 9A is a plan view perspective diagram of a substrate 330 of a droplet ejection head according to the second embodiment of the present invention, and FIG. 9B is a cross-sectional diagram along line 9B-9B in FIG. 9A. In FIGS. 9A and 9B, elements which are the same as or similar to those in the first embodiment are denoted with the same or similar reference numerals and description thereof is omitted here.

The droplet ejection head according to the second embodiment differs from the first embodiment in that a dummy pressure chamber 322, which has no nozzle as shown in FIG. 9B, is arranged on the side of the droplet ejection unit adjacent to the first main flow channel 211, in other words, the side adjacent to the bubble collection section 231.

According to the droplet ejection head of the second embodiment, it is possible to generate bubbles in the dummy pressure chamber, which does not contribute to image formation. By repeating pressurization and depressurization of the liquid in the dummy pressure chamber 322, it is possible to generate bubbles in the dummy pressure chamber or the connection channel by means of cavitation.

Since the dummy pressure chamber 322 has no nozzle, then the liquid is not ejected even if a high pressure is applied, and furthermore, image formation is not affected even if bubbles enter into the dummy pressure chamber 322.

Although FIGS. 9A and 9B depict the composition in which the dummy pressure chamber 322 is disposed on the side closest to the bubble collection section 231, the position of the dummy pressure chamber 322 is not limited in particular. However, it is desirable to arrange the dummy pressure chamber on the side closest to the bubble collection section 231, because this makes it easier to introduce bubbles into the stagnant flow region (the bubble collection section 231). Moreover, if the return channel 324 is connected to the side face of the common return channel 214 at a position above the bubble collection section 231, then the bubbles inside the bubble collection section 231 can circulate together with the flow of the liquid. Hence, it is desirable that the return channel 324 is connected to the common return channel 214 at a position other than the position above the bubble collection section 231.

In the second embodiment, it is also possible to use the actuator 225 of a droplet ejection unit that does not contribute to image formation as the actuator constituting the bubble detection device, which generates pressure and then determines the pressure rebound signal.

Figure 10:
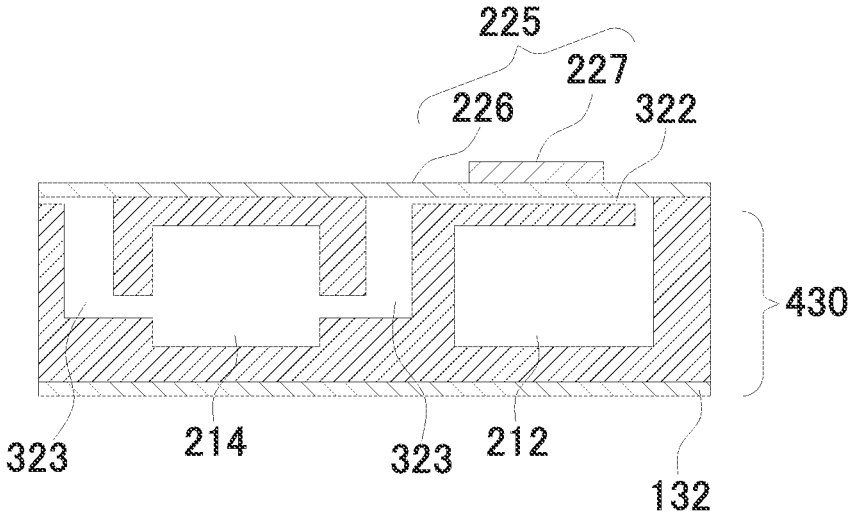
FIG. 10 is a cross-sectional diagram showing another droplet ejection head according to the second embodiment.

FIG. 10 shows a cross-sectional diagram of another droplet ejection head according to the second embodiment. The cross-sectional diagram in FIG. 10 is taken at the position where the dummy pressure chamber 322 is arranged, and coincides with the position of the cross-sectional diagram along 9B-9B in FIG. 9A. A substrate 430 of the droplet ejection head shown in FIG. 10 differs from the substrate 330 of the droplet ejection head shown in FIG. 9B in that the common supply channel 212 directly opens and connects with the dummy pressure chamber 322, rather than through the supply channel, and furthermore, the common return channel 214 directly opens and connects with the connection channel 323. By designing the dummy pressure chamber 322 and the common supply channel 212, and the connection channel 323 and the common return channel 214 in the open states as shown in FIG. 10, it is possible to generate bubbles in the dummy pressure chamber or the connection channel, in a similar manner to the droplet ejection head shown in FIGS. 9A and 9B.

Third Embodiment

A droplet ejection head according to the third embodiment has a nozzle that is connected to the connection channel of the droplet ejection unit that does not contribute to image formation, in the droplet ejection head in the second embodiment. In other words, the structure of the droplet ejection unit is similar to the structure of the first embodiment and is therefore not shown in the drawings. The fact that the droplet ejection unit not contributing to image formation is used to introduce bubbles differs from the first embodiment.

According to the droplet ejection head in the third embodiment, since bubbles can be introduced through the ejection port that does not contribute to image formation, then it is possible to collect bubbles in the common return channel readily. As a method of introducing bubbles from the ejection port, it is possible to employ a similar method to that of the first embodiment. Moreover, in the third embodiment, in contrast to the first embodiment, it is possible to apply a high pressure to the droplet ejection unit to introduce bubbles, since the ejection unit does not contribute to image formation. Consequently, it is possible to introduce bubbles more readily than the droplet ejection head 100 in the first embodiment.

Furthermore, in the third embodiment as well, there are no particular restrictions on the position of the droplet ejection unit that does not contribute to image formation, similarly to the arrangement of the droplet ejection unit in the second embodiment; however, it is desirably disposed at the nearest position to the bubble collection section.

It is also possible to adopt a composition which includes either one of the droplet ejection unit that does not contribute to image formation according to the second embodiment or the droplet ejection unit having the ejection port that does not contribute to image formation according to the third embodiment, or to adopt a composition which includes both of these.

In the third embodiment, similarly to the second embodiment, it is possible to use the actuator of the droplet ejection unit that does not contribute to image formation, as the actuator for detection of bubbles.

Fourth Embodiment

Figure 11:
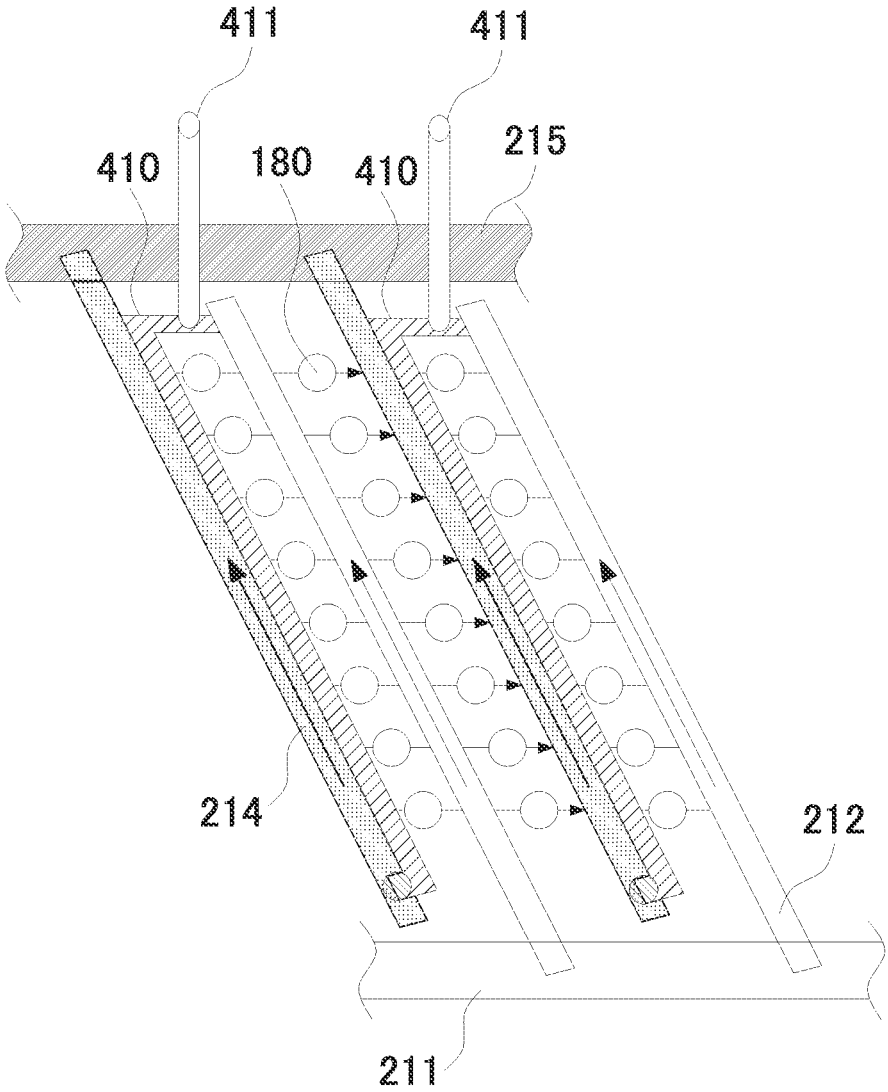
FIG. 11 is a plan view perspective diagram of a droplet ejection head according to a fourth embodiment of the present invention.

FIG. 11 is a plan view perspective diagram of a droplet ejection head according to the fourth embodiment of the present invention. In FIG. 11, elements which are the same as or similar to those in the first and second embodiments are denoted with the same or similar reference numerals and description thereof is omitted here. The fourth embodiment differs from the other embodiments in that the droplet ejection head has bypass flow channels 410, which connect the common supply channels 212 to the common return channels 214. The bypass flow channels 410 are provided with air flow channels 411, which connect with the atmosphere, on the common supply channel 212 sides. By arranging the air flow channels 411, it is possible to introduce bubbles readily into the stagnant flow regions. Air which goes beyond the stagnant flow region flows with the liquid through the common return channel 214, and the liquid is then deaerated and circulated again to the common supply channel 212. Although there are no particular restrictions on the positions of the bypass flow channels 410, it is desirable that each bypass flow channel 410 connects the extremity of the common supply channel 212 with the extremity of the common return channel 214. By connecting the bypass flow channel 410 with the extremity of the common supply channel 212, it is possible to convey the bubbles which have collected in the extremity of the common supply channel 212, to the common return channel 214.

Fifth Embodiment

Figure 12:
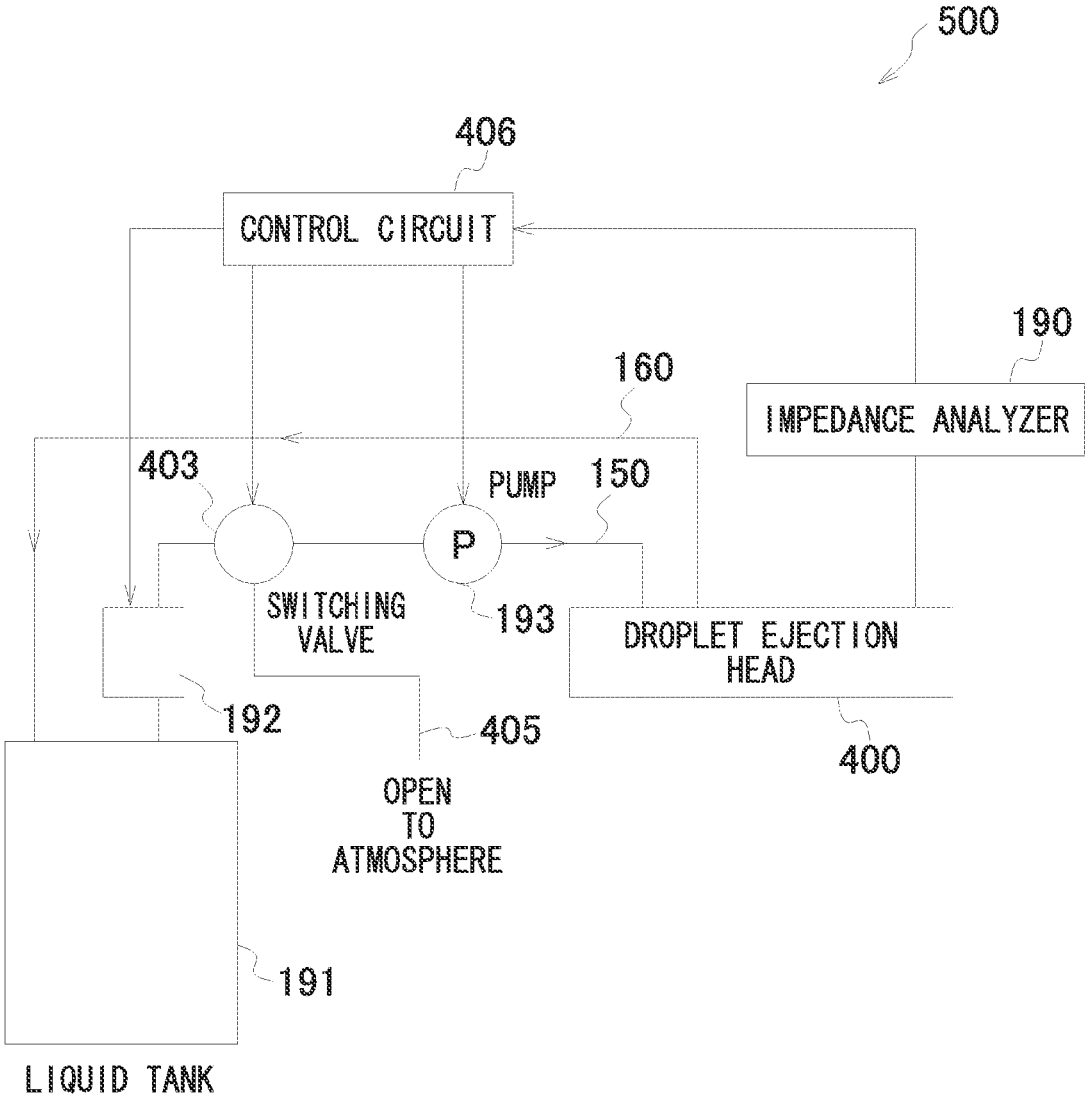
FIG. 12 is a schematic drawing of a droplet ejection apparatus having a droplet ejection head according to a fifth embodiment of the present invention.

FIG. 12 shows a schematic drawing of a droplet ejection apparatus 500 having a droplet ejection head 400 according to the fifth embodiment of the present invention. In FIG. 12, elements which are the same as or similar to those in the first to fourth embodiments are denoted with the same or similar reference numerals and description thereof is omitted here.

As shown in FIG. 12, the supply tube 150 in the droplet ejection apparatus 500 is provided with an air flow tube 405, which connects with the air and introduces bubbles, and a switching valve 403, which adjusts the incorporation of bubbles from the air flow tube 405. The structure of the droplet ejection head 400 can be similar to that of the first embodiment.

In the fifth embodiment, it is possible to introduce bubbles through the air flow tube 405 by arranging the air flow tube 405 at an intermediate point of the supply tube 150, and switching between the air flow tube 405 and the supply tube 150 from the liquid tank 401 by means of the switching valve 403. The bubbles introduced through the air flow tube 405 pass through the supply tube 150 and move to the common return channel 214 by means of circulation of the ink liquid. During this, the bubbles pass through the common supply channels 212 and the pressure chambers 222, but due to the circulating action, the bubbles can be made to circulate without stagnating in the common supply channels 212 or pressure chambers 222.

In the droplet ejection apparatus 500, a control circuit 406 obtains signals from the impedance analyzer 190, and adjusts the volume of bubbles inside the common return channel 214 by controlling the circulation pump 193, the switching valve 403 and the deaeration device 192.

Figure 13:
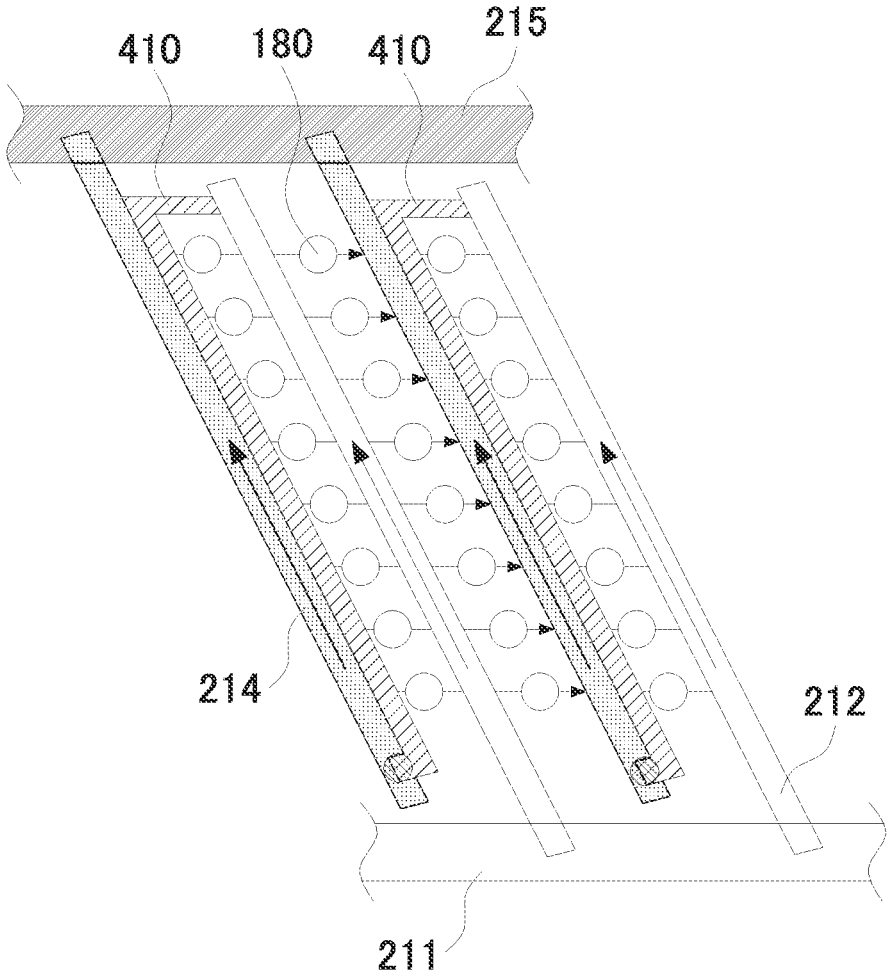
FIG. 13 is an enlarged diagram showing a flow channel structure including a bypass flow channel.

In the fifth embodiment, it is desirable that the droplet ejection head 400 is provided with the bypass flow channels 410, which connect the common supply channels 212 to the common return channels 214, as shown in FIG. 13. By arranging the bypass flow channels 410, when introducing bubbles, it is possible to convey the bubbles from the common supply channel 212 to the common return channel 214, without the bubbles entering into the pressure chambers 222. Hence, when forming an image, since no bubbles enter into the pressure chambers, then it is possible to form a good image. Although there are no particular restrictions on the positions of the bypass flow channels 410, similarly to the fourth embodiment, it is desirable that each bypass flow channel 410 connects the extremity of the common supply channel 212 with the extremity of the common return channel 214. By connecting the bypass flow channel 410 with the extremity of the common supply channel 212, it is possible to convey the bubbles which have collected in the extremity of the common supply channel 212, to the common return channel 214.

Further, the bypass flow channels 410 are not limited to the fifth embodiment and can also be arranged in the first to third embodiments. By arranging the bypass flow channels in the first to third embodiments, it is possible to convey bubbles inside the common supply channels to the common return channels without passing through the pressure chambers, and therefore it is possible to prevent bubbles from entering into the pressure chambers and giving rise to ejection defects. Furthermore, by making the pressure variation large at the outlets of the bypass flow channels 410, it is possible to generate bubbles by circulation also. As the method of creating a large pressure variation at the outlets of the bypass flow channels 410, it is possible to adopt a composition where the bypass flow channels 410 are tapered so that the bypass flow channels become narrower from the common supply channels 212 toward the common return channels 214, for example, thereby obtaining the greatest pressure variation at the outlets of the bypass flow channels.

Image Formation Method

Figure 14:
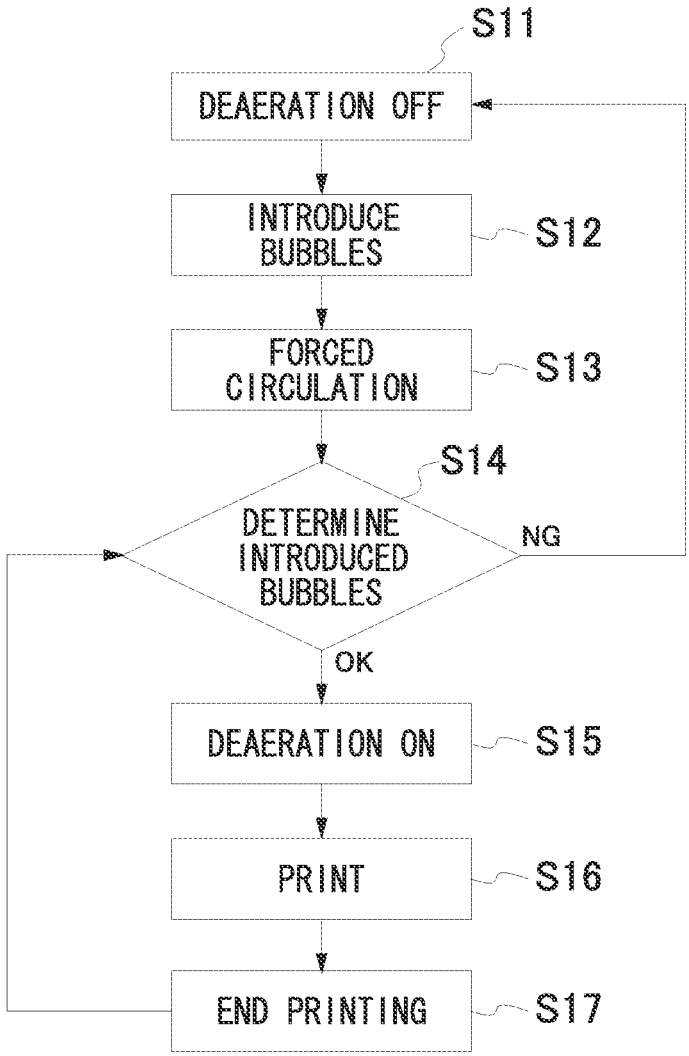
FIG. 14 is a flowchart of image formation according to an embodiment of the present invention.
Figure 15:
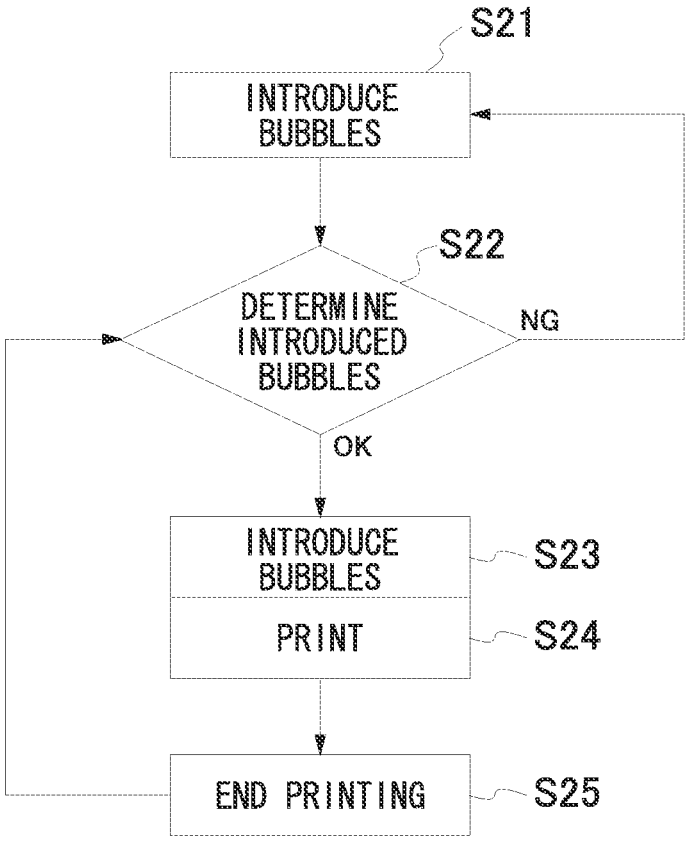
FIG. 15 is a flowchart of image formation according to another embodiment of the present invention.

FIGS. 14 and 15 show flowcharts of image formation using the droplet ejection head according to embodiments of the present invention. FIG. 14 is the flowchart of a case where bubbles are introduced before image formation, and FIG. 15 is the flowchart of a case where bubbles are introduced during image formation.

If bubbles are introduced before image formation, then as shown in FIG. 14, firstly, in a state where the deaeration device arranged in the supply tube 150 is not driven (S11), bubbles are introduced as described above (S12). Thereupon, by forcibly circulating the liquid at the stage where the bubbles have collected in the bubble collection section, the bubbles present in the locations where the liquid is circulated are caused to travel forcibly (S13). The bubbles are determined by the bubble detection device (S14), and if the volume of the introduced bubbles is insufficient, then the procedure returns to S12, and the introduction of bubbles is carried out again. The introduction of bubbles is repeated until bubbles of the required volume are detected. If the bubbles of the required volume are detected, then the deaeration device is driven (S15), and image formation (S16) is carried out. When the image formation has been completed (S17), the presence of bubbles is detected again, and if the volume of introduced bubbles is sufficient, then image formation is continued, whereas if the volume of introduced bubbles is insufficient, then image formation is carried out after introducing bubbles again.

FIG. 15 is the flowchart diagram of the case where bubbles can be generated during image formation, as in the droplet ejection head according to the third embodiment. Similarly to FIG. 14, firstly, bubbles are introduced (S21) in FIG. 15 also. The introduction of bubbles can be performed by generating bubbles in the dummy pressure chambers or by another of the methods described above. After introducing the bubbles, the bubbles are determined by the determination device (S21). If the volume of the introduced bubbles is insufficient, then the procedure returns to S21, and the introduction of bubbles is carried out again. The introduction of bubbles is repeated until bubbles of the required volume are detected. If the bubbles of the required volume are detected, then bubbles are further generated in the dummy pressure chambers and the bubbles are introduced into the common return channel (S23), as well as performing image formation (S24). If the droplet ejection head is provided with the dummy pressure chambers which have no nozzles, then the liquid is not ejected from the dummy pressure chambers even if pressure is applied during image formation, and therefore it is possible to generate bubbles in the dummy pressure chambers during image formation. Furthermore, it is also possible to introduce bubbles according to requirements, while determining the bubbles with the bubble detection device. When the image formation has been completed (S25), the bubbles are determined again and if the volume of introduced bubbles is sufficient, then image formation is continued, whereas if the volume of introduced bubbles is insufficient, then the procedure returns to S21 and image formation is carried out after introducing bubbles again.

Experimental Example

Figure 16:
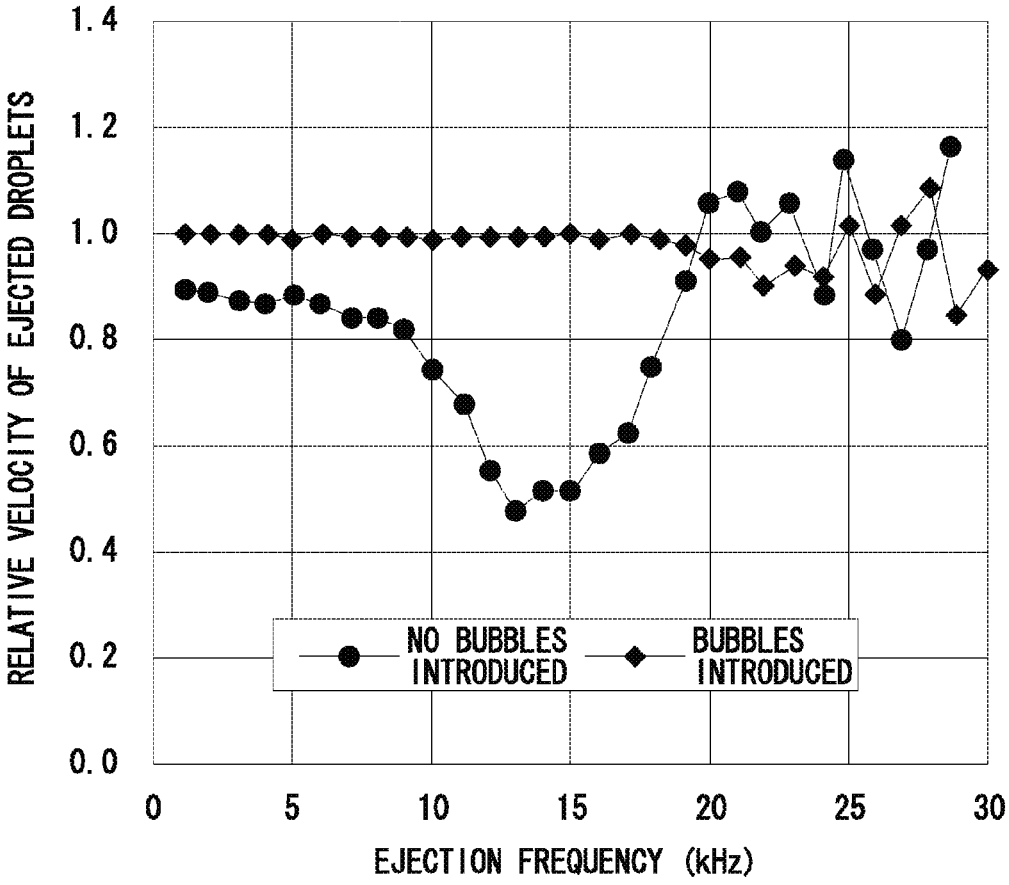
FIG. 16 is a graph showing the relationship between the ejection frequency and the relative velocity of the ejected ink droplets, in relation to the presence or absence of bubbles.

FIG. 16 shows relative values of the velocity of the ejected ink droplets with respect to frequency of the ejection, depending on the presence or absence of bubbles in the common return channels 214. As shown in FIG. 16, a stable droplet velocity was achieved by collecting bubbles in the common return channels 214. In the experimental example where no bubbles were introduced, decline in the droplet velocity with respect to the ejection frequency was observed.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A droplet ejection head, comprising:

a plurality of droplet ejection units which include: ejection ports through which droplets of liquid are ejected; pressure chambers which are connected to the ejection ports through connection channels; drive elements which apply pressure to the liquid in the pressure chambers; supply channels through which the liquid is supplied to the pressure chambers; and return channels through which the liquid is returned from the connection channels;

a common supply channel through which the liquid is supplied to the supply channels; and a common return channel through which the liquid is returned from the return channels, the common return channel including a stagnant flow region having a bubble collection section where bubbles are collected, wherein pressure variation occurring in each pressure chamber when ejecting a droplet of the liquid propagates more readily in the common return channel than in the common supply channel.

2. The droplet ejection head as defined in claim 1, wherein a flow channel resistance of the return channels is smaller than a flow channel resistance of the supply channels.

3. The droplet ejection head as defined in claim 1, further comprising:

a dummy pressure chamber which does not contribute to ejection of the liquid and to which the liquid is supplied from the common supply channel; and a second drive element which applies pressure to the liquid in the dummy pressure chamber to generate the bubbles.

4. The droplet ejection head as defined in claim 3, wherein a flow channel from the common supply channel through the dummy pressure chamber to the common return channel is in a closed state.

5. The droplet ejection head as defined in claim 3, further comprising a dummy ejection port which is connected to the dummy pressure chamber and does not contribute to ejection of the liquid.

6. The droplet ejection head as defined in claim 1, further comprising a bypass flow channel which connects the common supply channel with the common return channel.

7. The droplet ejection head as defined in claim 6, wherein the bypass flow channel includes an air flow channel which connects to atmosphere.

8. The droplet ejection head as defined in claim 1, further comprising a bubble detection device which detects the bubbles in the common return channel.

9. A droplet ejection apparatus, comprising:

the droplet ejection head as defined in claim 1;

a circulation device which is connected to the common supply channel and the common return channel and circulates the liquid; and a drive device which drives the drive elements and serves as a bubble introduction device which introduces the bubbles into the liquid.

10. The droplet ejection apparatus as defined in claim 9, further comprising:

a bubble detection device which detects the bubbles in the common return channel; and a control device which controls the bubble introduction device in accordance with a result obtained by the bubble detection device.

11. A droplet ejection apparatus, comprising:

the droplet ejection head as defined in claim 4;

a circulation device which is connected to the common supply channel and the common return channel and circulates the liquid; and a drive device which drives the second drive element and serves as a bubble generation device which generates the bubbles in the dummy pressure chamber.

12. The droplet ejection apparatus as defined in claim 11, further comprising:

a bubble detection device which detects the bubbles in the common return channel; and a control device which controls the bubble generation device in accordance with a result obtained by the bubble detection device.

13. A droplet ejection apparatus, comprising:

the droplet ejection head as defined in claim 5;

a circulation device which is connected to the common supply channel and the common return channel and circulates the liquid; and a drive device which drives the second drive element and serves as a bubble introduction device which introduces the bubbles from the dummy ejection port.

14. The droplet ejection apparatus as defined in claim 13, further comprising:

a bubble detection device which detects the bubbles in the common return channel; and a control device which controls the bubble introduction device in accordance with a result obtained by the bubble detection device.

15. A droplet ejection apparatus, comprising:

the droplet ejection head as defined in claim 1;

a supply tube through which the liquid is supplied to the common supply channel, the supply tube including an air flow tube which connects to atmosphere and has a valve;

a return tube through which the liquid is returned from the common return channel; and a circulation device which is connected to the supply tube and the return tube and circulates the liquid, wherein the air flow tube and the circulation device serve as a bubble introduction device which introduces the bubbles into the liquid.

16. The droplet ejection apparatus as defined in claim 15, further comprising:

a bubble detection device which detects the bubbles in the common return channel; and a control device which controls the bubble introduction device in accordance with a result obtained by the bubble detection device.

17. A method of collecting bubbles in a droplet ejection head in a droplet ejection apparatus which comprises:

the droplet ejection head, including: a plurality of droplet ejection units which include ejection ports through which droplets of liquid are ejected, pressure chambers which are connected to the ejection ports through connection channels, drive elements which apply pressure to the liquid in the pressure chambers, supply channels through which the liquid is supplied to the pressure chambers, and return channels through which the liquid is returned from the connection channels; a common supply channel through which the liquid is supplied to the supply channels; and a common return channel through which the liquid is returned from the return channels, the common return channel including a stagnant flow region having a bubble collection section where bubbles are collected, wherein pressure variation occurring in each pressure chamber when ejecting a droplet of the liquid propagates more readily in the common return channel than in the common supply channel;

a circulation device which is connected to the common supply channel and the common return channel and circulates the liquid; and a drive device which drives the drive elements and serves as a bubble introduction device which introduces the bubbles into the liquid, the method comprising the step of introducing the bubbles from one of the ejection ports by driving a corresponding one of the drive elements.

18. The method as defined in claim 17, wherein:

the droplet ejection apparatus further comprises: a bubble detection device which detects the bubbles in the common return channel; and a control device which controls the bubble introduction device in accordance with a result obtained by the bubble detection device; and the method further comprises the step of controlling a volume of the bubbles in the common flow channel in accordance with the result obtained by the bubble detection device.

19. A method of collecting bubbles in a droplet ejection head in a droplet ejection apparatus which comprises:

the droplet ejection head, including: a plurality of droplet ejection units which include ejection ports through which droplets of liquid are ejected, pressure chambers which are connected to the ejection ports through connection channels, drive elements which apply pressure to the liquid in the pressure chambers, supply channels through which the liquid is supplied to the pressure chambers, and return channels through which the liquid is returned from the connection channels; a common supply channel through which the liquid is supplied to the supply channels; a common return channel through which the liquid is returned from the return channels, the common return channel including a stagnant flow region having a bubble collection section where bubbles are collected; a dummy pressure chamber which does not contribute to ejection of the liquid and to which the liquid is supplied from the common supply channel; and a second drive element which applies pressure to the liquid in the dummy pressure chamber to generate the bubbles, wherein: pressure variation occurring in each pressure chamber when ejecting a droplet of the liquid propagates more readily in the common return channel than in the common supply channel; and a flow channel from the common supply channel through the dummy pressure chamber to the common return channel is in a closed state;

a circulation device which is connected to the common supply channel and the common return channel and circulates the liquid; and a drive device which drives the second drive element and serves as a bubble generation device which generates the bubbles in the dummy pressure chamber, the method comprising the step of generating the bubbles in the dummy pressure chamber by driving the second drive element.

20. The method as defined in claim 19, wherein:

the droplet ejection apparatus further comprises: a bubble detection device which detects the bubbles in the common return channel; and a control device which controls the bubble generation device in accordance with a result obtained by the bubble detection device; and the method further comprises the step of controlling a volume of the bubbles in the common flow channel in accordance with the result obtained by the bubble detection device.

21. A method of collecting bubbles in a droplet ejection head in a droplet ejection apparatus which comprises:

the droplet ejection head, including: a plurality of droplet ejection units which include ejection ports through which droplets of liquid are ejected, pressure chambers which are connected to the ejection ports through connection channels, drive elements which apply pressure to the liquid in the pressure chambers, supply channels through which the liquid is supplied to the pressure chambers, and return channels through which the liquid is returned from the connection channels; a common supply channel through which the liquid is supplied to the supply channels; a common return channel through which the liquid is returned from the return channels, the common return channel including a stagnant flow region having a bubble collection section where bubbles are collected; a dummy pressure chamber which does not contribute to ejection of the liquid and to which the liquid is supplied from the common supply channel; a second drive element which applies pressure to the liquid in the dummy pressure chamber to generate the bubbles; and a dummy ejection port which is connected to the dummy pressure chamber and does not contribute to ejection of the liquid, wherein pressure variation occurring in each pressure chamber when ejecting a droplet of the liquid propagates more readily in the common return channel than in the common supply channel;

a circulation device which is connected to the common supply channel and the common return channel and circulates the liquid; and a drive device which drives the second drive element and serves as a bubble introduction device which introduces the bubbles from the dummy ejection port, the method comprising the step of introducing the bubbles from the dummy ejection port by driving the second drive element.

22. The method as defined in claim 21, wherein:

the droplet ejection apparatus further comprises: a bubble detection device which detects the bubbles in the common return channel; and a control device which controls the bubble introduction device in accordance with a result obtained by the bubble detection device; and the method further comprises the step of controlling a volume of the bubbles in the common flow channel in accordance with the result obtained by the bubble detection device.

23. A method of collecting bubbles in a droplet ejection head in a droplet ejection apparatus which comprises:

the droplet ejection head, including: a plurality of droplet ejection units which include ejection ports through which droplets of liquid are ejected, pressure chambers which are connected to the ejection ports through connection channels, drive elements which apply pressure to the liquid in the pressure chambers, supply channels through which the liquid is supplied to the pressure chambers, and return channels through which the liquid is returned from the connection channels; a common supply channel through which the liquid is supplied to the supply channels; and a common return channel through which the liquid is returned from the return channels, the common return channel including a stagnant flow region having a bubble collection section where bubbles are collected, wherein pressure variation occurring in each pressure chamber when ejecting a droplet of the liquid propagates more readily in the common return channel than in the common supply channel;

a supply tube through which the liquid is supplied to the common supply channel, the supply tube including an air flow tube which connects to atmosphere and has a valve;

a return tube through which the liquid is returned from the common return channel; and a circulation device which is connected to the supply tube and the return tube and circulates the liquid, wherein the air flow tube and the circulation device serve as a bubble introduction device which introduces the bubbles into the liquid, the method comprising the step of introducing the bubbles from the air flow tube by driving the circulation device.

24. The method as defined in claim 23, wherein:

the droplet ejection apparatus further comprises: a bubble detection device which detects the bubbles in the common return channel; and a control device which controls the bubble introduction device in accordance with a result obtained by the bubble detection device; and the method further comprises the step of controlling a volume of the bubbles in the common flow channel in accordance with the result obtained by the bubble detection device.

* * * * *